US011896095B2

(12) United States Patent
Li et al.

(10) Patent No.: US 11,896,095 B2
(45) Date of Patent: Feb. 13, 2024

(54) UMBRELLA SLIDING ASSEMBLY

(71) Applicant: Zhejiang Yotrio Group Co., Ltd., Linhai taizhou (CN)

(72) Inventors: Xueping Li, Linhai taizhou (CN); Jianping Xie, Linhai taizhou (CN)

(73) Assignee: Zhejiang Yotrio Group Co., Ltd., Linhai (CN)

( * ) Notice: Subject to any disclaimer, the term of this patent is extended or adjusted under 35 U.S.C. 154(b) by 65 days.

(21) Appl. No.: 17/606,698

(22) PCT Filed: Apr. 21, 2020

(86) PCT No.: PCT/CN2020/085900
§ 371 (c)(1),
(2) Date: Oct. 26, 2021

(87) PCT Pub. No.: WO2020/216215
PCT Pub. Date: Oct. 29, 2020

(65) Prior Publication Data

US 2022/0211150 A1 Jul. 7, 2022

(30) Foreign Application Priority Data

Apr. 26, 2019 (CN) ..... 201920591833.8

(51) Int. Cl.
*A45B 23/00* (2006.01)
*A45B 25/02* (2006.01)

(52) U.S. Cl.
CPC ..... *A45B 23/00* (2013.01); *A45B 25/02* (2013.01); *A45B 2023/0012* (2013.01); *A45B 2023/0037* (2013.01); *A45B 2023/0068* (2013.01)

(58) Field of Classification Search
CPC ..... A45B 23/00; A45B 2023/0012
See application file for complete search history.

(56) References Cited

U.S. PATENT DOCUMENTS 8,104,492 B2 * 1/2012 Dan ..... A45B 25/14 135/21
9,220,325 B2 * 12/2015 Ma ..... A45B 23/00
(Continued)

FOREIGN PATENT DOCUMENTS

CN 2283383 Y 6/1998
CN 207011845 U 2/2018
(Continued)

OTHER PUBLICATIONS

English translation of International Patent Applicaiton No. PCT/CN2020/085900, International Search Report mailed Jul. 22, 2020, 2 pgs.

*Primary Examiner* — Noah Chandler Hawk
(74) *Attorney, Agent, or Firm* — Schwegman Lundberg & Woessner, P.A.

(57) ABSTRACT

A umbrella sliding assembly, includes a post, a slider, a first pulley, a second pulley and a fixing piece. The post is provided with a first track groove and a second track groove. The slider is arranged on the post. The first or second pulley is rotatably mounted on the slider and arranged in a row along a longitudinal direction of the slider, and extends into the first or second track groove, so that the first or second pulley pulley abuts against an inner wall of the first or second track groove. The fixing piece is mounted on the slider and includes a fixing part matchingly fixed with the post, when the fixing part is matchingly fixed with the post, the slider is fixed to the post, and when the fixing part is separated from the post, the slider is movable along a longitudinal direction of the postumbrella sliding assembly.

8 Claims, 6 Drawing Sheets

(56) References Cited

U.S. PATENT DOCUMENTS

| | | | | |
|---|---|---|---|---|
| 10,136,709 | B2 * | 11/2018 | Ma | A45B 23/00 |
| 10,758,016 | B1 * | 9/2020 | Wang | A45B 25/08 |
| 2006/0090784 | A1 * | 5/2006 | Ma | A45B 25/14 135/98 |
| 2021/0251352 | A1 * | 8/2021 | Fisher | A45B 25/06 |

FOREIGN PATENT DOCUMENTS

| | | | |
|---|---|---|---|
| CN | 109380830 | A | 2/2019 |
| CN | 210299842 | U | 4/2020 |
| DE | 202012104758 | U1 | 3/2013 |
| KR | 20170108348 | A | 9/2017 |

* cited by examiner

UMBRELLA SLIDING ASSEMBLY

This application is a U.S. National Stage Filing under 35 U.S.C. 371 from International Application No. PCT/CN2020/085900, filed on Apr. 21, 2020, and published as WO 2020/216215 A1 on Oct. 29, 2020, which claims the benefit of priority to Chinese Patent Application No. 201920591833.8, filed on Apr. 26, 2019, each of which is incorporated by reference herein in its entirety.

TECHNICAL FIELD

The disclosure relates to a technical field of outdoor furniture, in particular to a umbrella sliding assembly.

BACKGROUND ART

With continuous development of society, a parasol with functions of shielding sunlight and providing shade are widely used in families, swimming pools, hotels, guest-houses and other entertainment services. Such a parasol generally includes a post on which a slider is provided, the slider is connected with a canopy through a connecting rod and can slide along a longitudinal direction of the post. When the canopy is opened or closed, the slider moves to different positions on the post in cooperation with the post. However, an existing slider is generally connected with the post in a sliding fit, and sliding friction between the slider and the post is large, which is easy to cause a problem of unsmooth sliding. Meanwhile, it is easy to cause great wear on the post, and to cause damage and deformation on a surface of the post after being used for a long time.

SUMMARY

In view of above problems and in order to overcome at least one of shortcomings, the disclosure provides a umbrella sliding assembly.

Technical schemes adopted in the disclosure is as follows.

A umbrella sliding assembly includes:

a post provided with a first track groove and a second track groove which are longitudinally disposed;

a slider longitudinally movably mounted to the post;

at least two first pulleys rotatably mounted to the slider and arranged in a row along a longitudinal direction of the slider, the first pulleys extending into the first track groove and bringing the first pulleys to abut against an inner wall of the first track groove;

at least two second pulleys rotatably mounted on the slider and arranged in a row along the longitudinal direction of the slider, the second pulleys extending into the second track groove and bringing the second pulleys to abut against an inner wall of the second track groove; and a fixing piece mounted on the slider and including a fixing part matchingly fixed with the post, when the fixing part is matchingly fixed with the post, the slider being fixed to the post, and when the fixing part is separated from the post, the slider being movable along a longitudinal direction of the post.

In an embodiment of the disclosure, the first track groove is formed by recessing inwardly a side of the post, and the first pulley abuts against a side wall of the first track groove; the second track groove is formed by recessing inwardly two side walls of the first track groove respectively, and the second pulley abuts against a bottom wall of the second track groove.

In an embodiment of the disclosure, the second track groove includes two symmetrical groove bodies which are respectively arranged on two side walls of the first track groove, and cross section of each of the groove bodies is a right-angled trapezoid in shape, and a lower bottom edge of the right-angled trapezoid corresponds to a bottom wall of the groove body.

In an embodiment of the disclosure, the slider includes a handle portion, a strip-shaped mounting portion, at least two first mounting posts and a strip-shaped inner liner. The handle portion is connected to one side of the mounting portion, while another side of the mounting portion is provided with at least two mounting grooves in which the first mounting posts are provided, the at least two first mounting posts are arranged in a row along a length direction of the mounting portion, and the first pulley and the second pulley are sleeved on the first mounting posts in turn so that the first pulley is loaded into the mounting groove, and the second pulley abuts against outside of the mounting groove; and the inner liner is arranged on another side of the second pulley and is fixed with the first mounting posts through fasteners, so that the first pulley and the second pulley are limited between the mounting portion and the inner liner.

In an embodiment of the disclosure, the slider further includes a second mounting post provided on the mounting portion, the second mounting post is located on a same line as the first mounting post, the second pulley is sleeved on the second mounting post, and the inner liner is fixed with the second mounting post through the fasteners, thereby limiting the second pulley between the mounting portion and the inner liner.

In an embodiment of the disclosure, the mounting groove is provided at a joint of the handle portion and the mounting portion.

In an embodiment of the disclosure, a free end of the fixing part faces the bottom wall of the first track groove, and the free end of the fixing part is provided with a latch for cooperating with the bottom wall of the first track groove to fix the fixing piece on the post.

In an embodiment of the disclosure, the bottom wall of the first track groove protrudes toward the fixing piece to form an arc-shaped protrusion, an end face of the free end of the fixing part is arranged in an arc shape, corresponding to the arc-shaped protrusion, and the latch is formed on the end face of the free end of the fixing part.

In an embodiment of the disclosure, the fixing piece also includes a knob and a connecting screw, and the fixing part movably passes through the slider which limits rotation of the fixing part. A threaded hole is provided in the fixing part, the knob is arranged at a rear end of the fixing part, and the connecting screw passes through the knob and is inserted into the threaded hole, thereby connecting the knob and the fixing part, so that the fixing part can be driven to move by turning the knob so as to approach or move away from the bottom wall of the first track groove.

Compared with the prior art, the disclosure has following beneficial effects: in the umbrella sliding assembly of the disclosure, only rolling friction exists between the first pulley, the second pulley and the post during moving of the slider, which presents a small friction force; and with the provision of the first pulley and the second pulley, the slider does not tilt during the moving, and in this way wear on the post can be reduced, and the slider moves smoothly without jamming. The umbrella sliding assembly is simple in structure, requires low matching accuracy and is simple in manufacturing process, which can greatly improve productivity; and meanwhile, it is stable in structure, not easy to be worn and has a long service life.

DETAILED DESCRIPTION

Figure 1:
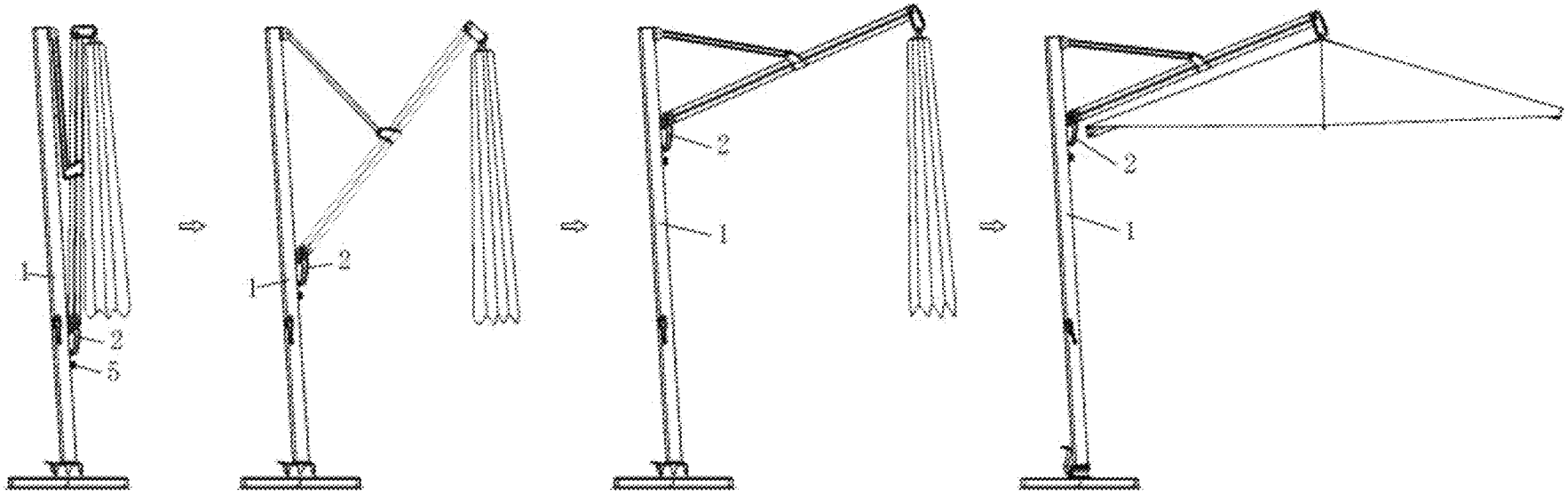
FIG. 1 is a schematic diagram of states in which a slider slides to different positions on a post in a umbrella sliding assembly according to the disclosure.
Figure 2:
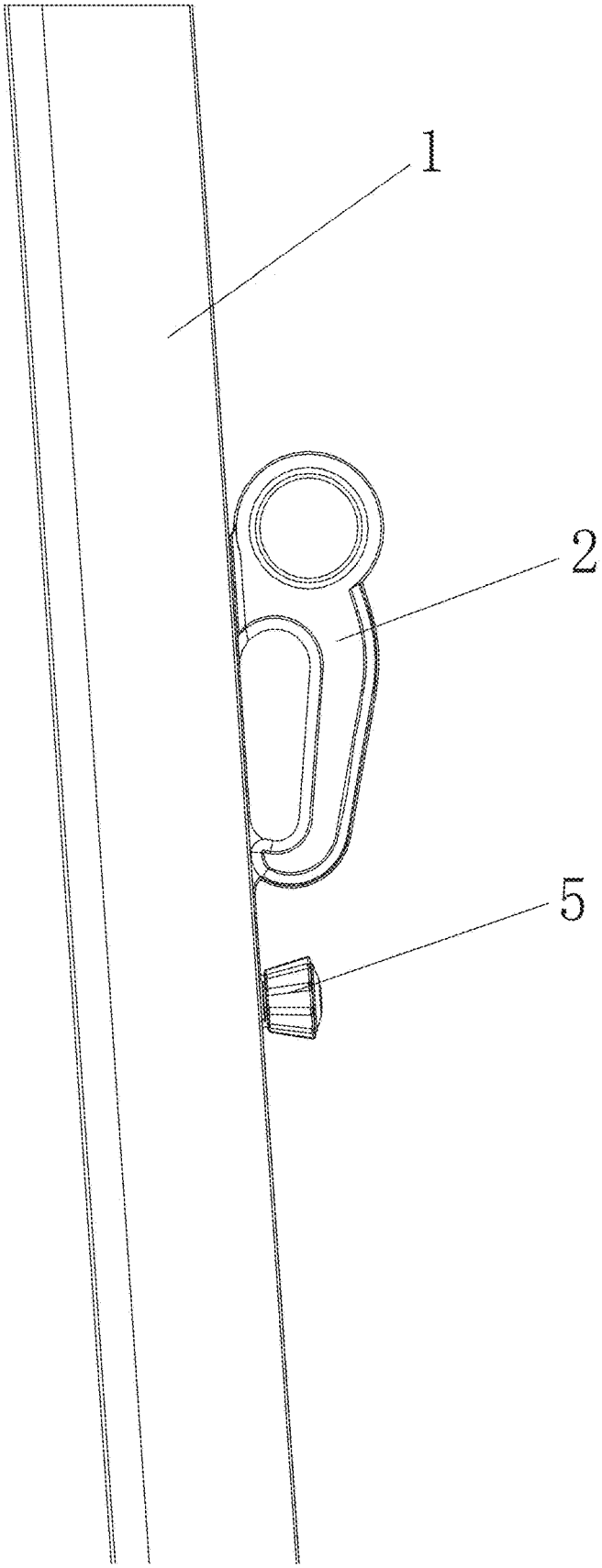
FIG. 2 is a perspective view of a umbrella sliding assembly according to the disclosure.
Figure 3:
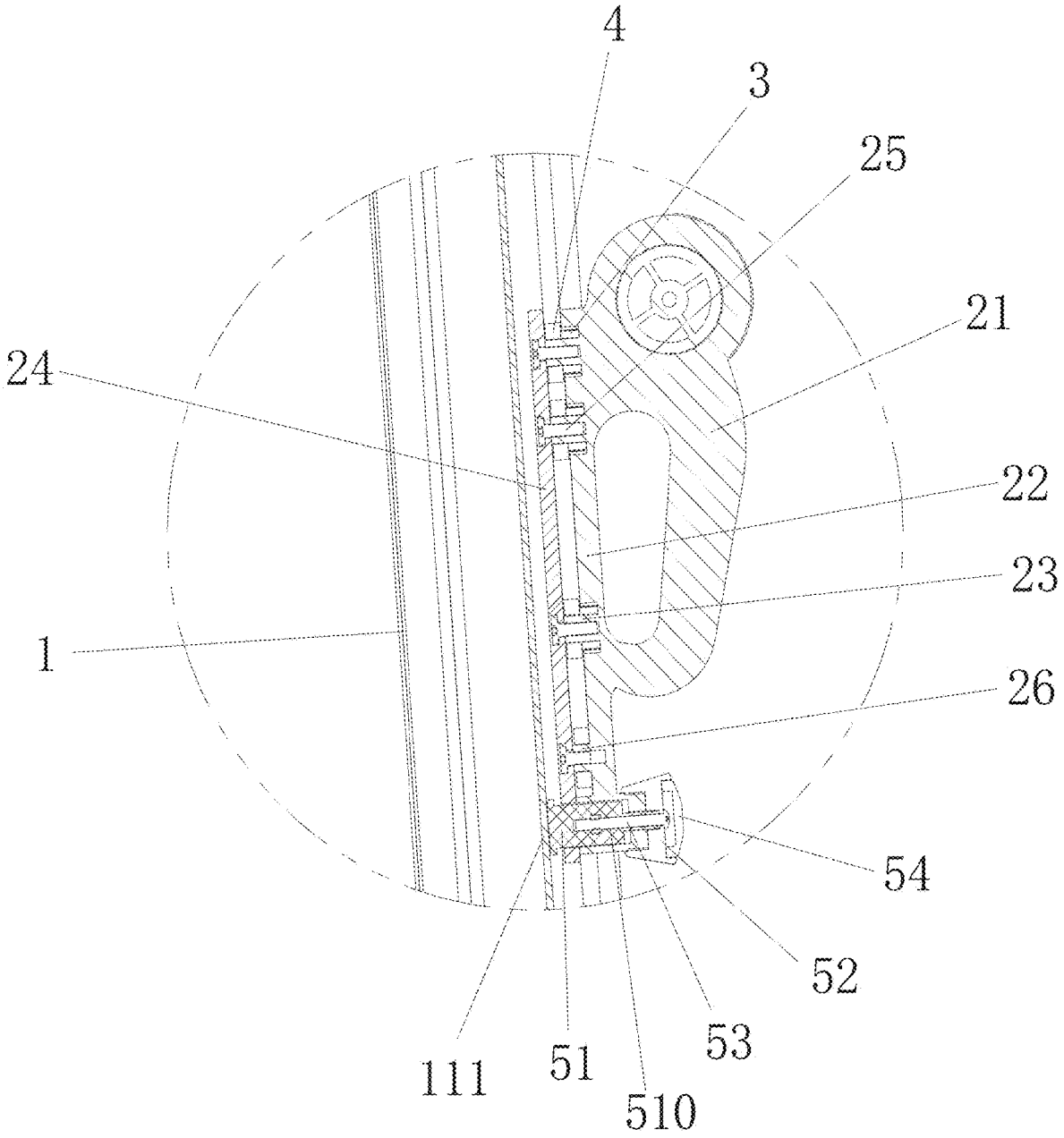
FIG. 3 is a partial sectional view of a umbrella sliding assembly according to the disclosure.
Figure 4:
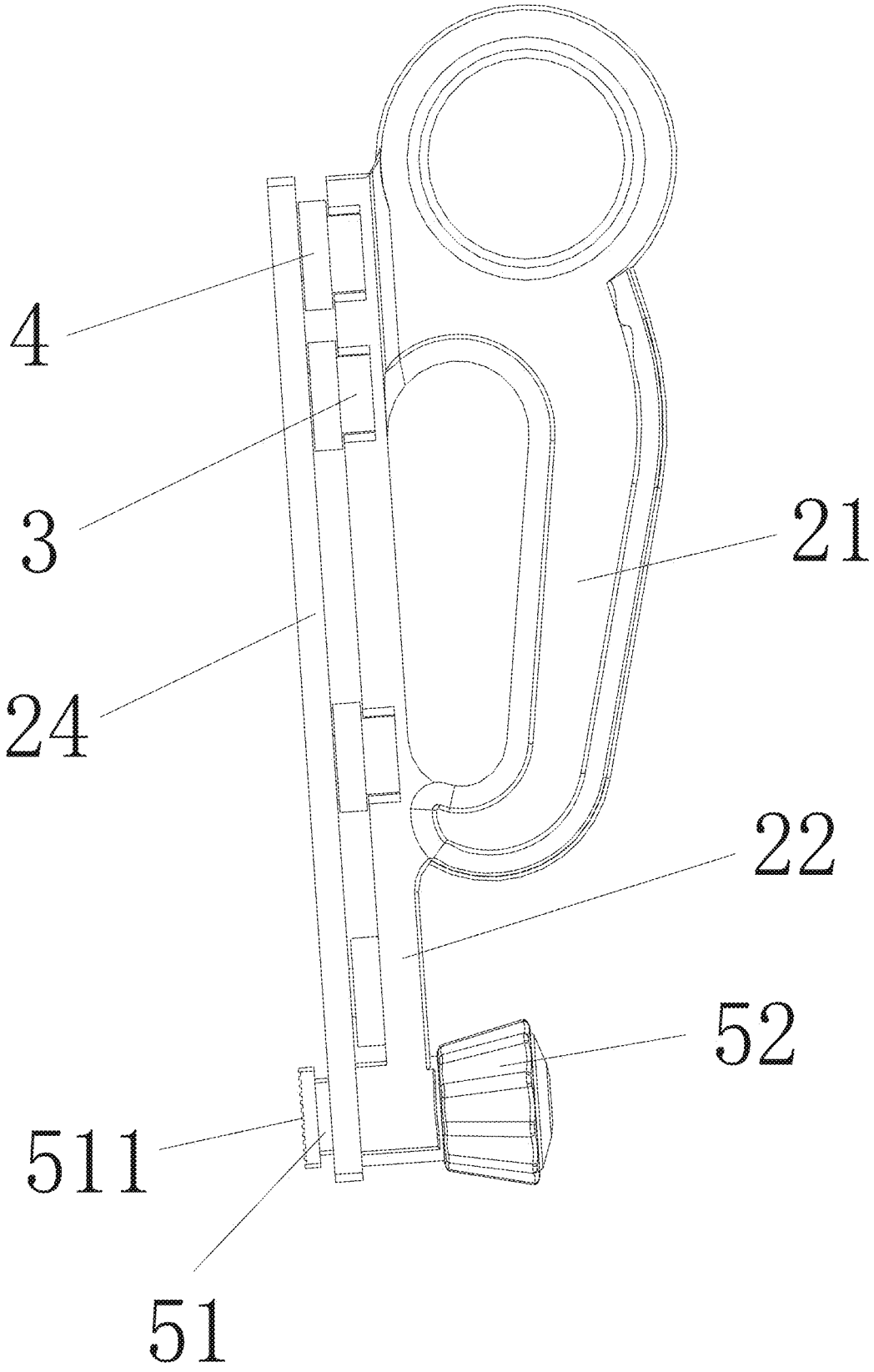
FIG. 4 is an assembly view of a slider of a umbrella sliding assembly according to the disclosure.
Figure 5:
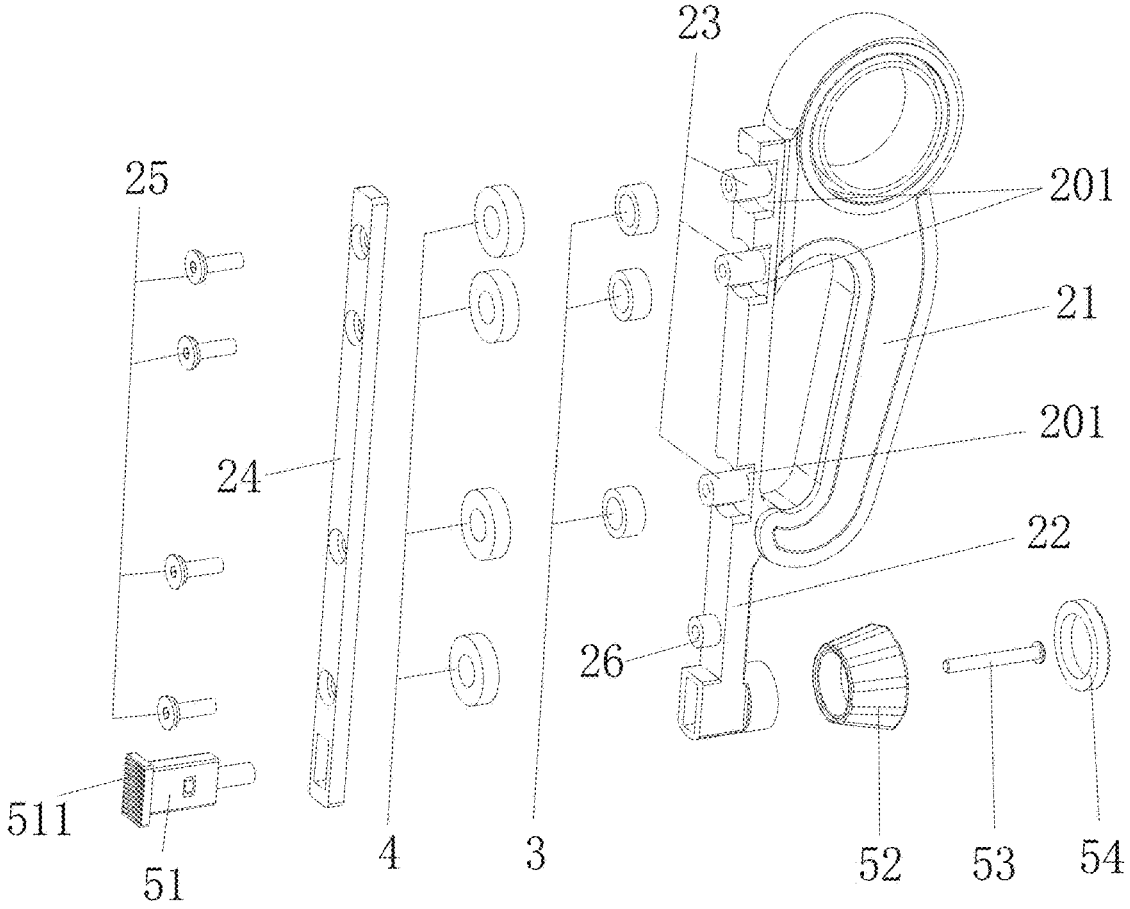
FIG. 5 is an exploded view of a structure shown in FIG. 4.
Figure 6:
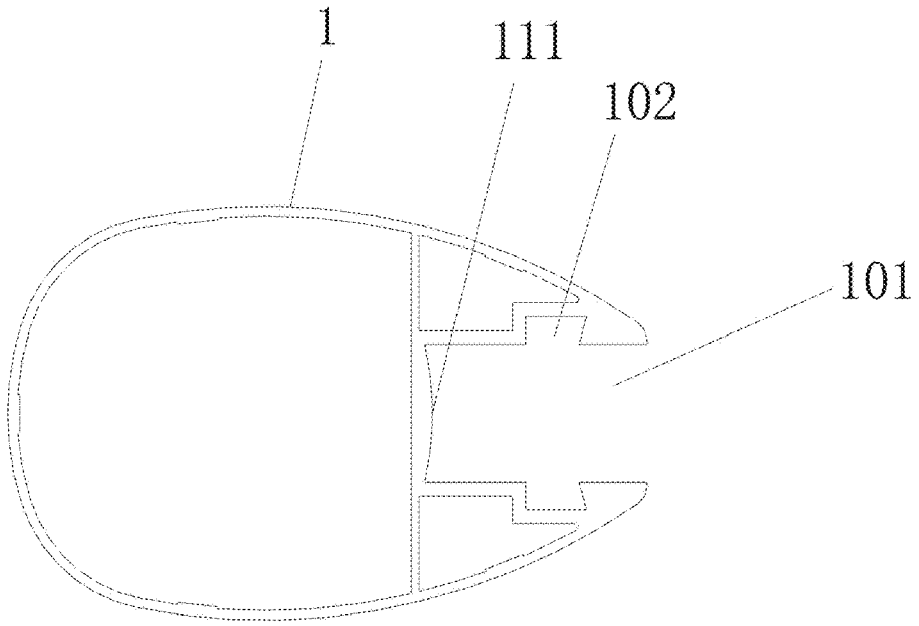
FIG. 6 is a sectional structural schematic diagram of a post of a umbrella sliding assembly according to the disclosure.
Figure 7:
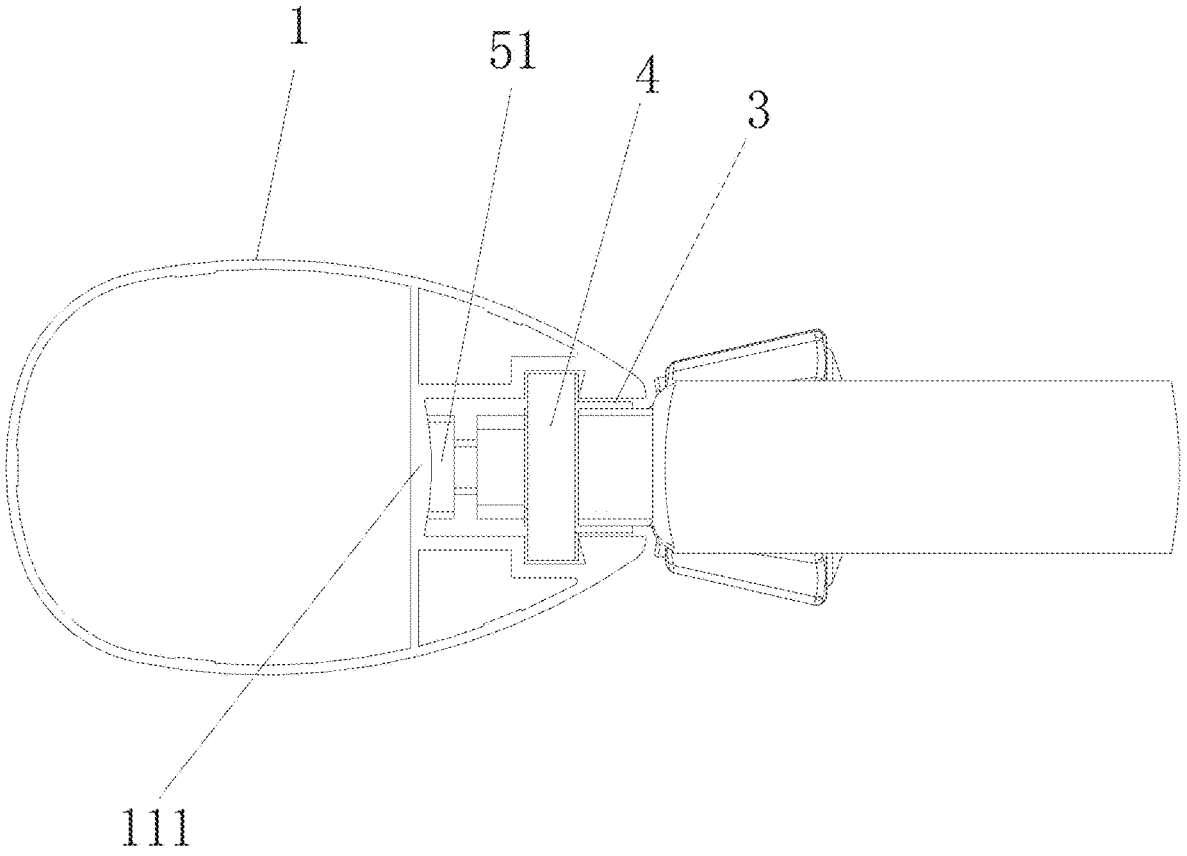
FIG. 7 is a top view of a umbrella sliding assembly according to the disclosure.

The present disclosure will be described in detail with reference to the accompanying drawings.

With reference to FIGS. 1 to 7, the disclosure provides a umbrella sliding assembly, which includes a post 1, a slider 2, at least two first pulleys 3, at least two second pulleys 4 and a fixing piece 5.

The post 1 is provided with a first track groove 101 and a second track groove 102 which are longitudinally disposed.

The slider 2 is longitudinally movably mounted to the post 1.

The at least two first pulleys 3 are rotatably mounted to the slider 2 and arranged in a row along a longitudinal direction of the slider 2, the first pulleys 3 extend into the first track groove 101 and bringing the first pulleys 3 to abut against an inner wall of the first track groove 101.

The at least two second pulleys 4 are rotatably mounted on the slider 2 and arranged in a row along the longitudinal direction of the slider 2, the second pulleys 4 extend into the second track groove 102 and bringing the second pulleys 4 to abut against an inner wall of the second track groove 102.

The fixing piece 5 is mounted on the slider 2 and includes a fixing part 51 matchingly fixed with the post 1, when the fixing part 51 is matchingly fixed with the post 1, the slider 2 is fixed to the post 1, and when the fixing part 51 is separated from the post 1, the slider 2 is movable along the longitudinal direction of the post 1.

In the umbrella sliding assembly of the disclosure, the slider 2 can move along the post 1 and can be fixed at any position on the post 1 through the fixing piece 5, as shown in FIG. 1. When the slider 2 is moved, the first pulley 3 rolls in the first track groove 101 and the second pulley 4 rolls in the second track groove 102. The slider 2 moves through the rolling of the first pulley 3 and the second pulley 4. The rolling friction resistance is very small, which can effectively reduce wear on the post 1 and greatly reduce probability of damage and deformation to the post 1.

At least two first pulleys 3 and at least two second pulleys 4 are provided, which ensures force balance of the slider 2 during moving, so that the slider 2 does not tilt during the moving, friction between the first pulleys 3 and second pulleys 4 and the post 1 can be reduced, so that the slider 2 move more smoothly without jamming.

The umbrella sliding assembly is simple in structure, requires low matching accuracy and is simple in manufacturing process, which can greatly improve productivity; and meanwhile, it is stable in structure, not easy to be worn and has a long service life.

Further, the first track groove 101 is formed by recessing inwardly a side of the post 1, and the first pulley 3 abuts against a side wall of the first track groove 101. The second track groove 102 is formed by recessing inwardly two side walls of the first track groove 101 respectively, and the second pulley 4 abuts against a bottom wall of the second track groove 102. In this embodiment, the second track groove 102 is arranged on the side wall of the first track groove 101, which is equivalent to the first track groove 101 crossing the second track groove 102. The second track groove 102 limits the second pulley 4, while the second pulley 4 limits the first pulley 3, so that the first pulley 3 rolls more smoothly in the first track groove 101.

In this document, "recessing inwardly" only indicates a form, that is, a structure that is concave relative to a surface of an object, but not a processing method. That is to say, the structure can be an inwardly recessing structure that is directly formed in molding the post 1, or an inwardly recessing structure that is formed by cutting, pressing, bending or other processing after the post 1 is molded, which is not limited in the disclosure.

Further, the second track groove 102 includes two symmetrical groove bodies which are respectively arranged on two side walls of the first track groove 101, and cross section of each of the groove bodies is a right-angled trapezoid in shape, and a lower bottom edge of the right-angled trapezoid corresponds to a bottom wall of the groove body. The right-angled trapezoidal groove body makes one side of the second pulley 4 in surface contact with the second track groove 102, and another side of the second pulley 4 in line contact with the second track groove 102, which not only ensures stability of the second pulley 4 rolling in the second track groove 102, but also reduces friction between the second pulley 4 and the second track groove 102, thus ensuring smooth moving of the slider 2.

Further, the slider 2 includes a handle portion 21, a strip-shaped mounting portion 22, at least two first mounting posts 23 and a strip-shaped lining member 24. The handle portion 21 is connected to one side of the mounting portion 22, while another side of the mounting portion 22 is provided with at least two mounting grooves 201. The first mounting posts 23 are disposed in the mounting grooves 201, and the at least two first mounting posts 23 are arranged in a row along a length direction of the mounting portion 22. The first pulley 3 and the second pulley 4 are sleeved on the first mounting posts 23 in turn so that the first pulley 3 is loaded into the mounting groove 201, and the second pulley 4 abuts against outside of the mounting groove 201; and the inner liner 24 is arranged on another side of the second pulley 4 and is fixed with the first mounting posts 23 through fasteners 25, so that the first pulley 3 and the second pulley 4 are limited between the mounting portion 22 and the inner liner 24. In this embodiment, the first pulley 3 is located in the mounting groove 201, and the second pulley 4 is located outside the mounting groove 201, and the first pulley 3 is limited by the second pulley 4, which can prevent the first pulley 3 from sliding out of the mounting groove 201, and avoid the first pulley 3 from shaking right and left or even tilting; the second pulley 4 is located outside the mounting groove 201 and abuts against the mounting portion 22, and the inner liner 24 is mounted on another side of the second pulley 4, that is, the second pulley 4 is limited by the inner liner 24 and the mounting portion 22, which can prevent the second pulley 4 from shaking right and left or even tilting. With stable mounting of the first pulley 3 and the second pulley 4 in the structure of this embodiment, it can be ensured that no inclining occurs after multiple uses and service life of products can be prolonged. The fastener 25 may be a grub screw.

The mounting groove 201 is provided at a joint of the handle portion 21 and the mounting portion 22. Structural strength of the joint between the handle portion 21 and the mounting portion 22 is high, and the mounting groove 201 does not affect overall structural stability of the slider 2 after being provided here, which can ensure mounting stability of the first pulley 3 and the second pulley 4.

The slider 2 further includes a second mounting post 26 provided on the mounting portion 22, the second mounting post 26 is located on a same line as the first mounting post 23, the second pulley 4 is sleeved on the second mounting post 26, and the inner liner 24 is fixed with the second mounting post 26 through the fasteners 25, thereby limiting the second pulley 4 between the mounting portion 22 and the inner liner 24. The first pulleys 3 and the second pulleys 4 are both at least two in number, and with a straight line being determined with two points, it thus can be ensured that an upper end and an lower end of the slider 2 do not tilt, thus further ensuring smooth moving of the slider 2. In this embodiment, there are three first pulleys 3 and four second pulleys 4, and three second pulleys 4 are mounted on the first mounting post 23 together with the first pulleys 3, and the remaining second pulley 4 is mounted on the second mounting post 26. In this way, the first pulleys 3 and the second pulleys 4 can arranged to better disperse a force borne by the slider 2, so that a pressure at each application point (where the first pulley 3 or the second pulley 4 contacts the post 1) is smaller, so that the slider 2 can support more pressure. However, it is not limited to this, and other number and distribution of the first pulley 3 and the second pulley 4 also is possible, which is not limited in the disclosure.

A free end of the fixing part 51 faces the bottom wall of the first track groove 101, and the free end of the fixing part 51 is provided with a latch 511 for cooperating with the bottom wall of the first track groove 101 to fix the fixing piece 5 on the post 1. The fixing part 51 is moved toward the bottom wall of the first track groove 101 by cooperation of the latch 511 with the bottom wall of the first track groove 101 so that the latch 511 closely abuts against the bottom wall of the first track groove 101, and then the slider 2 can be fixed on the post 1.

The bottom wall of the first track groove 101 protrudes toward the fixing piece 5 to form an arc-shaped protrusion 111, an end face of the free end of the fixing part 51 is arranged in an arc shape, corresponding to the arc-shaped protrusion 111, and the latch 511 is formed on the end face of the free end of the fixing part 51. The end face of the free end of the fixing part 51 is arranged in an arc shape and has a larger contact area with the arc-shaped protrusion 111, so that the latch 511 can better lock the arc-shaped protrusion 111 and fix the slider 2 on the post 1.

The fixing piece 5 also includes a knob 52 and a connecting screw 53, and the fixing part 51 movably passes through the slider 2 which limits rotation of the fixing part 51. A threaded hole 510 is provided in the fixing part 51, and the knob 52 is arranged at a rear end of the fixing part 5, and the connecting screw 53 passes through the knob 52 and is inserted into the threaded hole 510, thereby connecting the knob 52 and the fixing part 51, so that the fixing part 51 can be driven to move by turning the knob 52 so as to approach or move away from the bottom wall of the first track groove 101.

When the knob 52 is turned, the knob 52 rotates with the connecting screw 53 and the fixing part 51. Since the slider 2 limits rotation of the fixing part 51, the fixing part 51 can only move along a length direction of the screw, so as to approach or move away from the bottom wall of the first track groove 101 of the post 1. By tightening the knob 52, the fixing part 51 can closely abut against the bottom wall of the first track groove 101, thereby locking and fixing the slider 2 on the post 1; and by unscrewing the knob 52, the fixing part 51 can be separated from the bottom wall of the first track groove 101, so that the slider 2 can be moved to any position on the post 1, and this operation process is very convenient.

Further, a knob cover 54 is provided outside the knob 52 to cover the connecting screw 53, so as to provide an aesthetic appearance.

The disclosure has following beneficial effects: in the umbrella sliding assembly of the disclosure, only rolling friction exists between the first pulley 3, the second pulley 4 and the post 1 during moving of the slider 2, which presents a small friction force; and with the provision of the first pulley 3 and the second pulley 4, the slider 2 does not tilt during the moving, and in this way wear on the post 1 can be reduced, and the slider 2 moves smoothly without jamming.

The above is only preferred embodiments of the present disclosure, which does not limit a protection scope of the present disclosure. Any equivalent structural transformation made with the specification and drawings of the present disclosure, which is directly or indirectly applied to other related technical fields, is included within the scope of the disclosure.

The invention claimed is:

1. An umbrella sliding assembly, comprising:

a post provided with a first track groove and a second track groove, wherein the first track groove and the second track groove are longitudinally disposed;

a slider longitudinally movably mounted to the post;

at least two first pulleys rotatably mounted to the slider and arranged in a row along a longitudinal direction of the slider, the first pulleys extending into the first track groove and bringing the first pulleys to abut against an inner wall of the first track groove;

at least two second pulleys rotatably mounted on the slider and arranged in a row along the longitudinal direction of the slider, the second pulleys extending into the second track groove and bringing the second pulleys to abut against an inner wall of the second track groove; and a fixing piece mounted on the slider and including a fixing part matchingly fixed with the post, when the fixing part is matchingly fixed with the post, the slider being fixed to the post, and when the fixing part is separated from the post, the slider being movable along a longitudinal direction of the post, wherein the first track groove is formed by recessing inwardly a side of the post, and the first pulley abuts against a side wall of the first track groove; the second track groove is formed by recessing inwardly two side walls of the first track groove respectively, and the second pulley abuts against a bottom wall of the second track groove.

2. The umbrella sliding assembly according to claim 1, wherein the second track groove comprises two symmetrical groove bodies, the two symmetrical groove bodies are respectively arranged on two side walls of the first track groove, and cross section of each of the groove bodies is a right-angled trapezoid in shape, and a lower bottom edge of the right-angled trapezoid corresponds to a bottom wall of the groove body.

3. The umbrella sliding assembly according to claim 1, wherein the slider comprises a handle portion, a strip-shaped mounting portion, at least two first mounting posts and a strip-shaped inner liner, wherein the handle portion is connected to one side of the mounting portion, while another side of the mounting portion is provided with at least two mounting grooves in which the first mounting posts are provided, the at least two first mounting posts are arranged in a row along a length direction of the mounting portion, and the first pulley and the second pulley are sleeved on the first mounting posts in turn so that the first pulley is loaded into the mounting groove, and the second pulley abuts against outside of the mounting groove; and the inner liner is arranged on another side of the second pulley and is fixed with the first mounting posts through fasteners, so that the first pulley and the second pulley are limited between the mounting portion and the inner liner.

4. The umbrella sliding assembly according to claim 3, wherein the slider further comprises a second mounting post provided on the mounting portion, the second mounting post is located on a same line as the first mounting post, the second pulley is sleeved on the second mounting post, and the inner liner is fixed with the second mounting post through the fasteners, thereby limiting the second pulley between the mounting portion and the inner liner.

5. The umbrella sliding assembly according to claim 3, wherein the mounting groove is provided at a joint of the handle portion and the mounting portion.

6. The umbrella sliding assembly according to claim 1, wherein a free end of the fixing part faces the bottom wall of the first track groove, and the free end of the fixing part is provided with a latch for cooperating with the bottom wall of the first track groove to fix the fixing piece on the post.

7. The umbrella sliding assembly according to claim 1, wherein the bottom wall of the first track groove protrudes toward the fixing piece to form an arc-shaped protrusion, an end face of the free end of the fixing part is arranged in an arc shape, corresponding to the arc-shaped protrusion, and the latch is formed on the end face of the free end of the fixing part.

8. The umbrella sliding assembly according to claim 7, wherein the fixing piece also comprises a knob and a connecting screw, the fixing part movably passes through the slider which limits rotation of the fixing part, a threaded hole is provided in the fixing part, the knob is arranged at a rear end of the fixing part, and the connecting screw passes through the knob and is inserted into the threaded hole, thereby connecting the knob and the fixing part, so that the fixing part is driven to move by turning the knob so as to approach or move away from the bottom wall of the first track groove.

* * * * *